US009006597B2

(12) United States Patent
Hirata

(10) Patent No.: US 9,006,597 B2
(45) Date of Patent: Apr. 14, 2015

(54) PUSH SWITCH

(71) Applicant: Panasonic Corporation, Osaka (JP)

(72) Inventor: Yuki Hirata, Okayama (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 192 days.

(21) Appl. No.: 13/730,414

(22) Filed: Dec. 28, 2012

(65) Prior Publication Data

US 2013/0180837 A1 Jul. 18, 2013

(30) Foreign Application Priority Data

Jan. 17, 2012 (JP) ..... 2012-006701

(51) Int. Cl.
*H01H 13/10* (2006.01)
*H01H 13/81* (2006.01)
*H01H 1/58* (2006.01)

(52) U.S. Cl.
CPC ..... *H01H 13/10* (2013.01); *H01H 1/5805* (2013.01); *H01H 13/81* (2013.01); *H01H 2001/5888* (2013.01); *H01H 2207/032* (2013.01); *H01H 2225/028* (2013.01)

(58) Field of Classification Search
USPC ..... 200/292, 294, 406
See application file for complete search history.

(56) References Cited

U.S. PATENT DOCUMENTS

| | | | | |
|---|---|---|---|---|
| 7,576,291 | B2 * | 8/2009 | Tseng et al. | 200/296 |
| 7,906,741 | B2 * | 3/2011 | Yanai et al. | 200/406 |
| 8,455,778 | B2 * | 6/2013 | Yang et al. | 200/406 |
| 8,809,709 | B2 * | 8/2014 | Watanabe | 200/294 |
| 2001/0013466 | A1 | 8/2001 | Yanai et al. | |

FOREIGN PATENT DOCUMENTS

JP 2001-210176 A 8/2001

* cited by examiner

*Primary Examiner* — Renee S Luebke
*Assistant Examiner* — Ahmed Saeed
(74) *Attorney, Agent, or Firm* — McDermott Will & Emery LLP

(57) ABSTRACT

A push switch is configured to be mounted on an upper surface of a circuit board the circuit board having a land provided on the upper surface thereof and a side edge. The push switch includes a front section and a rear section. The front section includes a switch contact unit activated by being pushed in a predetermined direction, and is configured to be located outward from the side edge of the circuit board. The rear section includes a terminal connected with the switch contact unit the rear section extending from the front section, and is configured to be disposed on the upper surface of the circuit board. The rear section is connected with the front section, and configures substantially an L-shape in combination with the front section. The terminal is configured to be connected with the land of the circuit board. The predetermined direction is parallel to the upper surface of the circuit board. The gravity center of the push switch is located away from the front section in a direction in which the rear section extends from the front section.

8 Claims, 11 Drawing Sheets

PUSH SWITCH

TECHNICAL FIELD

The present invention relates to push switches used for input operation units and the like of various electronic apparatuses.

BACKGROUND

In recent years, push switches used for input operation units of various electronic apparatuses are lateral push type that operates when being pushed in a direction parallel to circuit boards onto which the push switches are mounted.

FIGS. 8 and 9 are a sectional view and an exploded perspective view of conventional push switch 500 disclosed in Japanese Patent Laid-Open Publication No. 2001-210176, respectively. Main body portion 2M of case 1 made of resin has a recess 2C having a circular shape opening to the front side. Main body portion 2M has bracket portion 3 unitarily formed on an upper position thereof such that it projects toward the rear side as well as to both the right and left sides. Outer contact 5 and center contact 7 are fixed by insert molding to an inner bottom surface of the recess 2C. Each of terminals connected with outer contact 5 and center contact 7 projects outward from positions around bracket portion 3.

Movable contact 9 of a circular dome shape made of elastic sheet metal is disposed inside the recess 2C with its outer rim, or the lower edge of the dome-like shape in contact with outer contact 5 of case 1. The recess 2C of case 1 is covered with insulation sheet 11 made of insulation film having flexibility, which is attached to a flat area around an outer periphery of the recess 2C from the front side.

Operating element 13 made of resin includes flange portion 13A, pressing portion 13B protruding in the center on a rear surface of flange portion 13A, and operating portion 13C protruding in the center on a front surface of flange portion 13A. Flange portion 13A has a rectangular plate shape in the front view. Operating element 13 is disposed movably in front-to-back direction with the periphery of flange portion 13A being guided by inner surfaces of guide walls extending from outer peripheral corners at the front side of case 1, thereby enabling the rear end of pressing portion 13B to depress the center portion of movable contact 9 backward through insulation sheet 11. Operating portion 13C protrudes forward through an opening in metal cover 15 attached to case 1.

FIGS. 10 and 11 are a perspective view and a sectional view of push switch 500 disposed on circuit board 19, respectively. Circuit board 19 has cutout 17 formed in a side edge thereof. Push switch 500 is disposed with bracket portion 3 placed on circuit board 19 such that main body portion 2M of case 1 is fitted in cutout 17. Push switch 500 is thus mounted on circuit board 19 in this position while terminals are soldered to lands.

When operating portion 13C is pushed backward under this mounted condition, operating element 13 moves horizontally backward while being guided, and causes pressing portion 13B to depress the center portion of movable contact 9 backward through insulation sheet 11. When the depressing force exceeds a predetermined amount, the center portion of movable contact 9 is reversed to have a reversed convex shape in association with a tactile response and comes in contact with center contact 7, and push switch 500 is turned on to connecting electrically between center contact 7 and outer contact 5. At this moment, the direction of the above pushing operation is parallel to the surface of circuit board 19 on which push switch 500 is mounted. Since movable contact 9 is depressed directly toward a direction corresponding to its operational direction by operating element 13 that moves horizontally, an excellent click feeling can be obtained from push switch 500 during the above pushing operation.

When the depressing force is removed from operating portion 13C, the center portion of movable contact 9 flips back to have the original forward convex shape and is removed from center contact 7, and operating element 13 is pushed back through insulation sheet 11 to turn off push switch 500.

Push switch 500 is disposed that main body portion 2M of case 1 is placed in cutout 17. However, there is a growing demand for push switches that can be placed and mounted in the similar manner on side edges of circuit boards not provided with cutouts 17 in order to hold circuit boards 19 to low cost.

SUMMARY

A push switch is configured to be mounted on an upper surface of a circuit board the circuit board having a land provided on the upper surface thereof and a side edge. The push switch includes a front section and a rear section. The front section includes a switch contact unit activated by being pushed in a predetermined direction, and is configured to be located outward from the side edge of the circuit board. The rear section includes a terminal connected with the switch contact unit the rear section extending from the front section, and is configured to be disposed on the upper surface of the circuit board. The rear section is connected with the front section, and configures substantially an L-shape in combination with the front section. The terminal is configured to be connected with the land of the circuit board. The predetermined direction is parallel to the upper surface of the circuit board. The gravity center of the push switch is located away from the front section in a direction in which the rear section extends from the front section.

This push switch is securely mountable to the side edge of the circuit board which does not have a cutout therein.

DETAIL DESCRIPTION OF PREFERRED EMBODIMENTS

Figure 1:
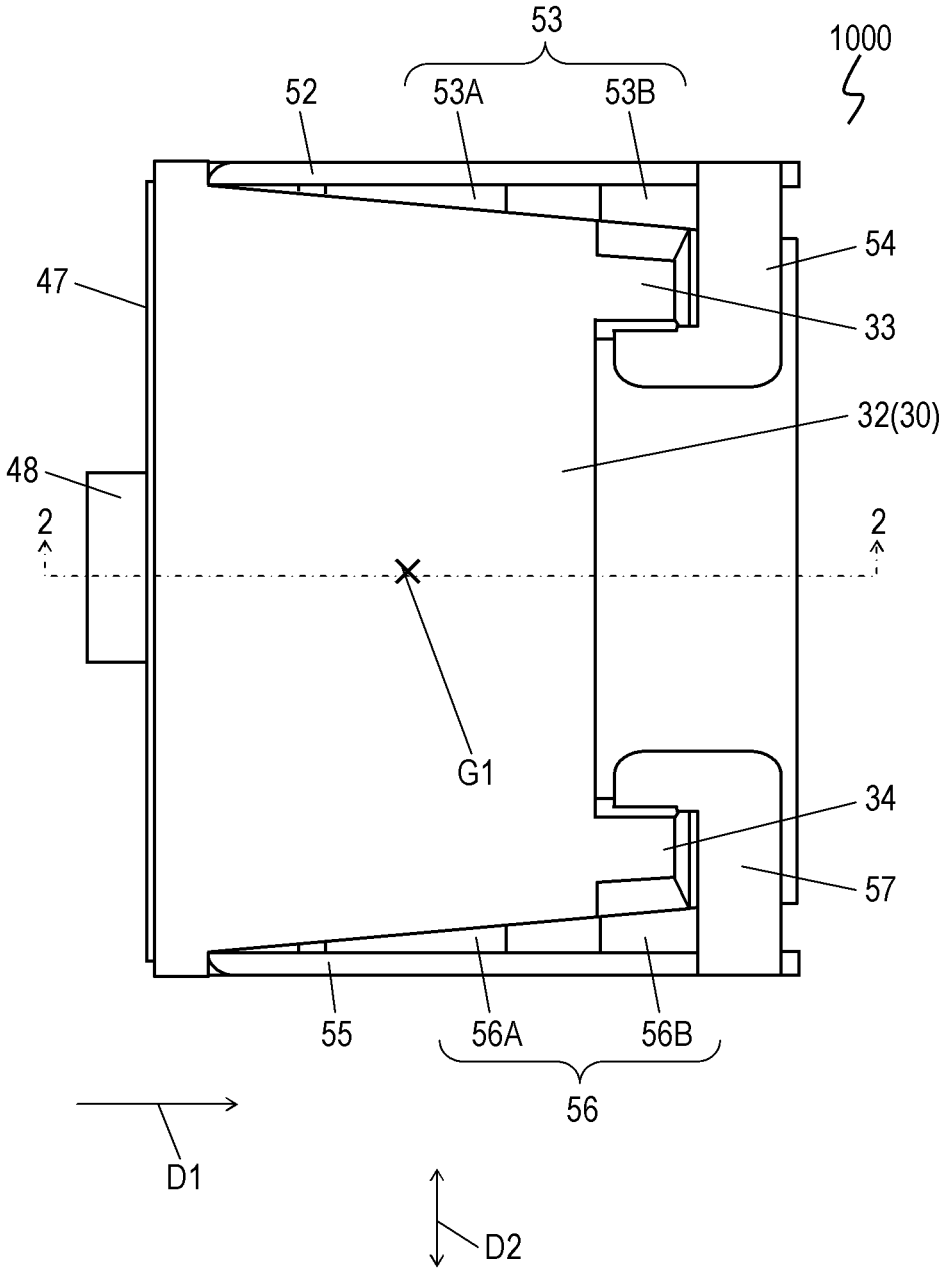
FIG. 1 is a top view of a push switch according to an exemplary embodiment of the present invention.
Figure 2:
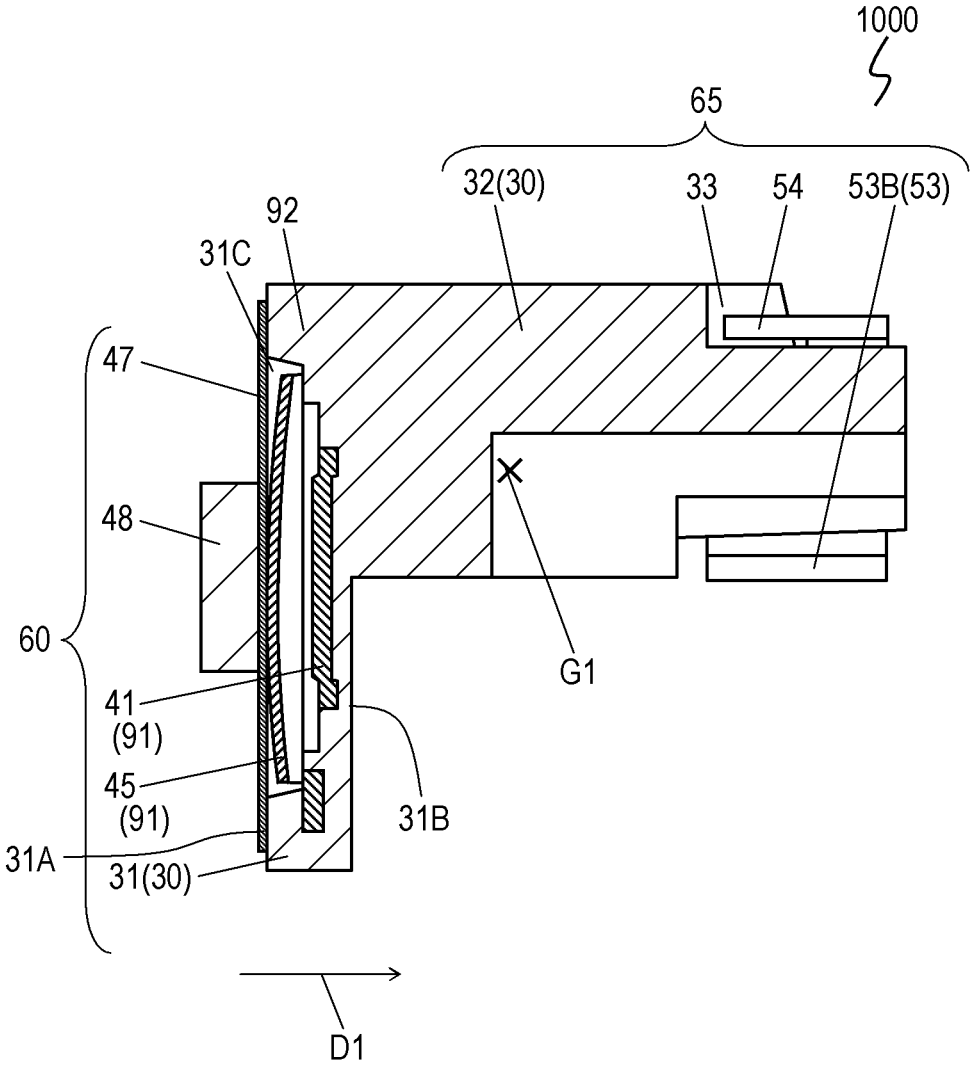
FIG. 2 is a sectional view of the push switch at line 2-2 shown in FIG. 1.
Figure 3:
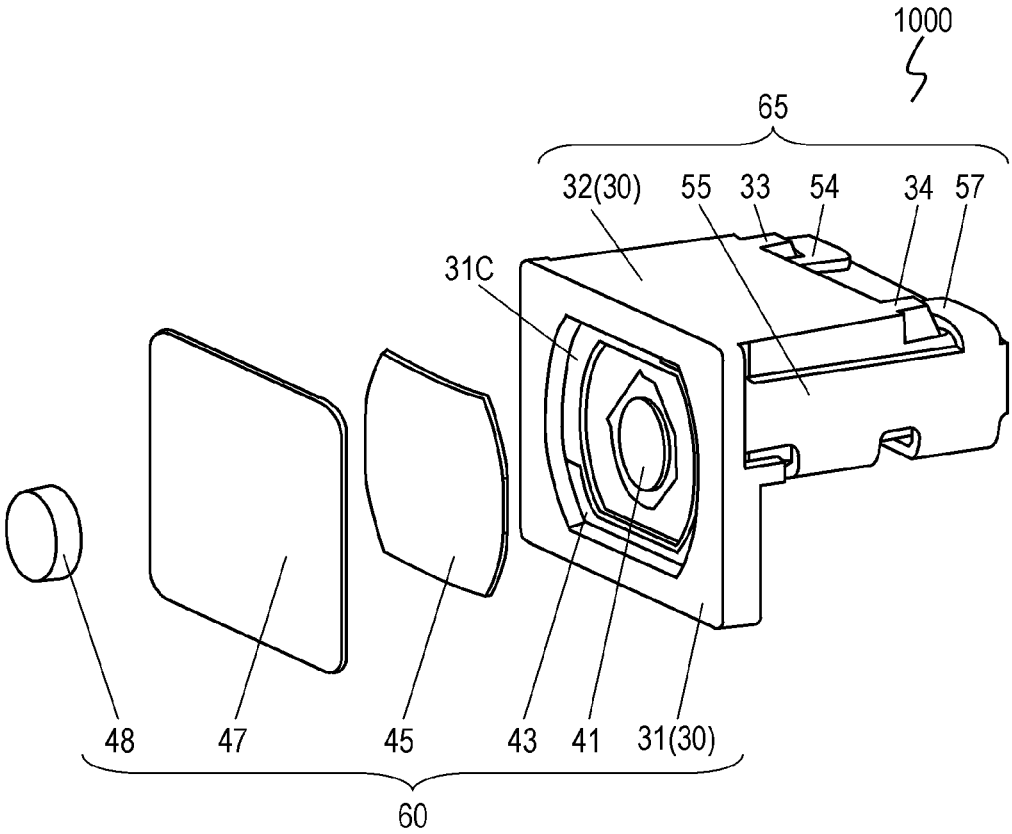
FIG. 3 is an exploded perspective view of the push switch according to the embodiment.
Figure 4:
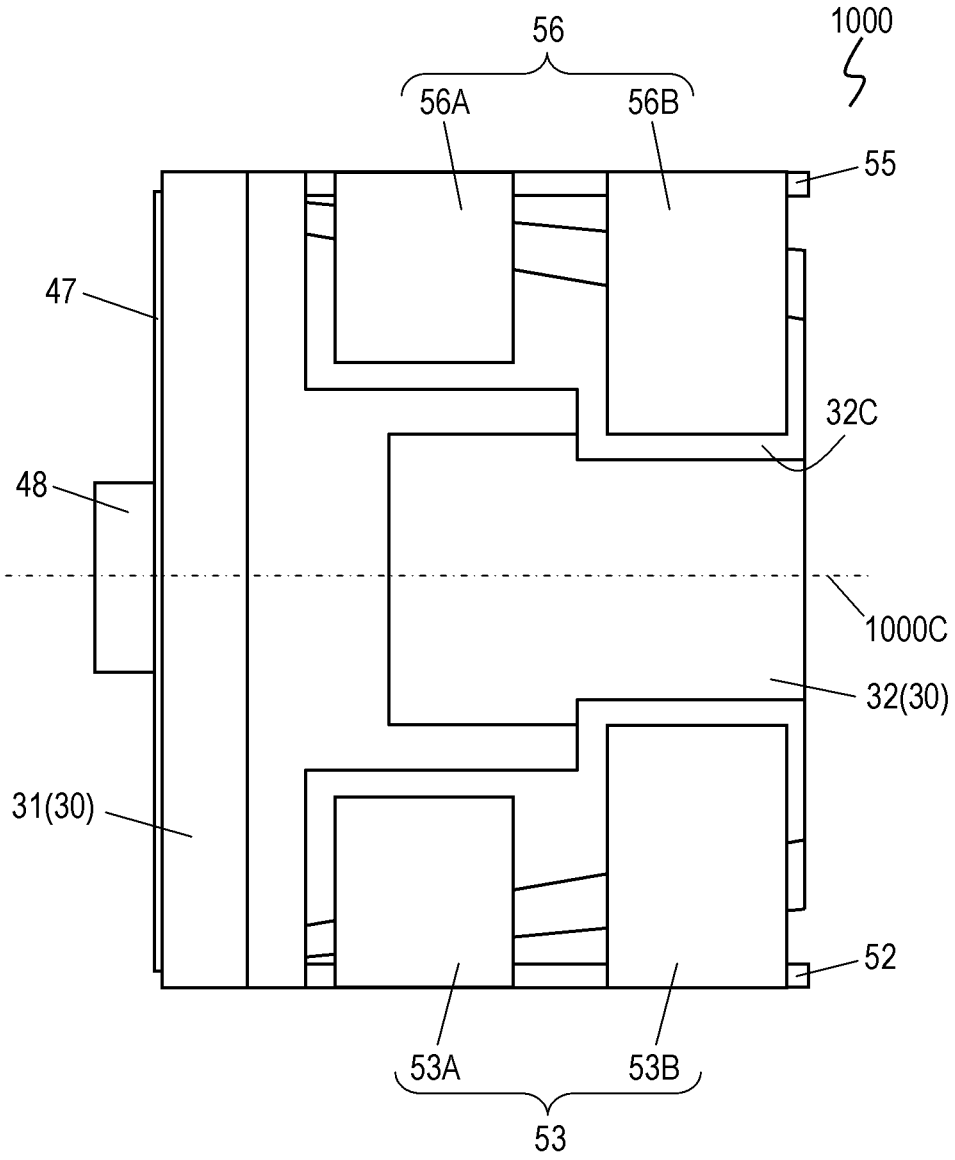
FIG. 4 is a bottom view of the push switch according to the embodiment.
Figure 5:
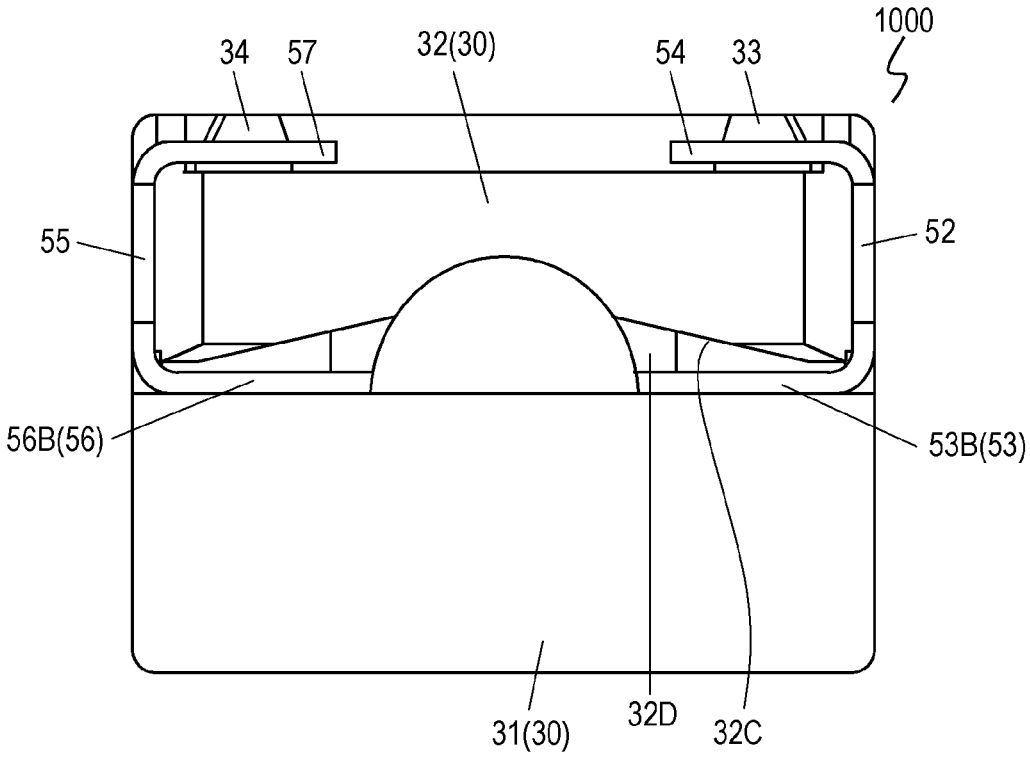
FIG. 5 is a rear view of the push switch according to the embodiment.
Figure 6:
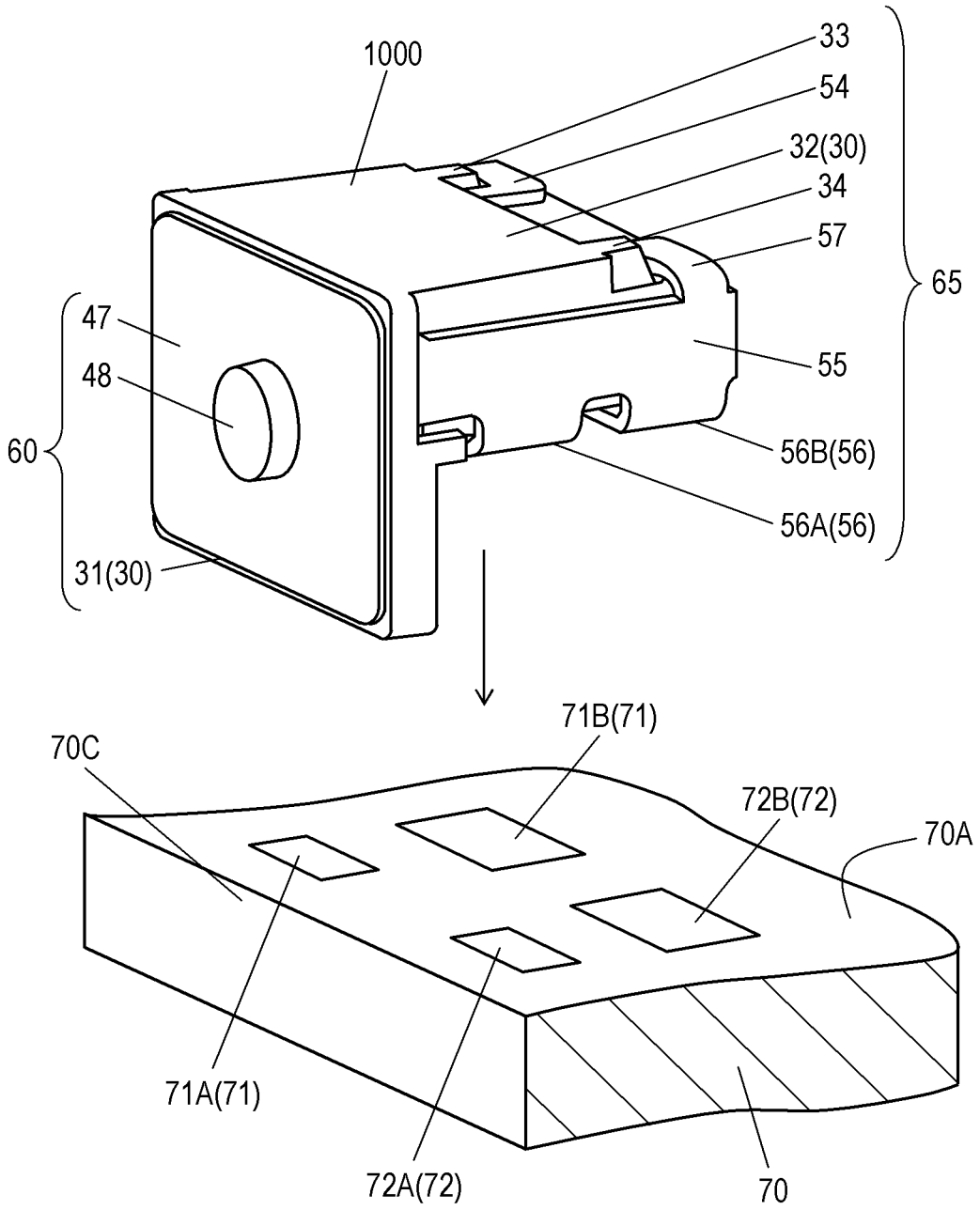
FIG. 6 is a perspective view of the push switch according to the embodiment which is to be mounted to a circuit board.
Figure 7:
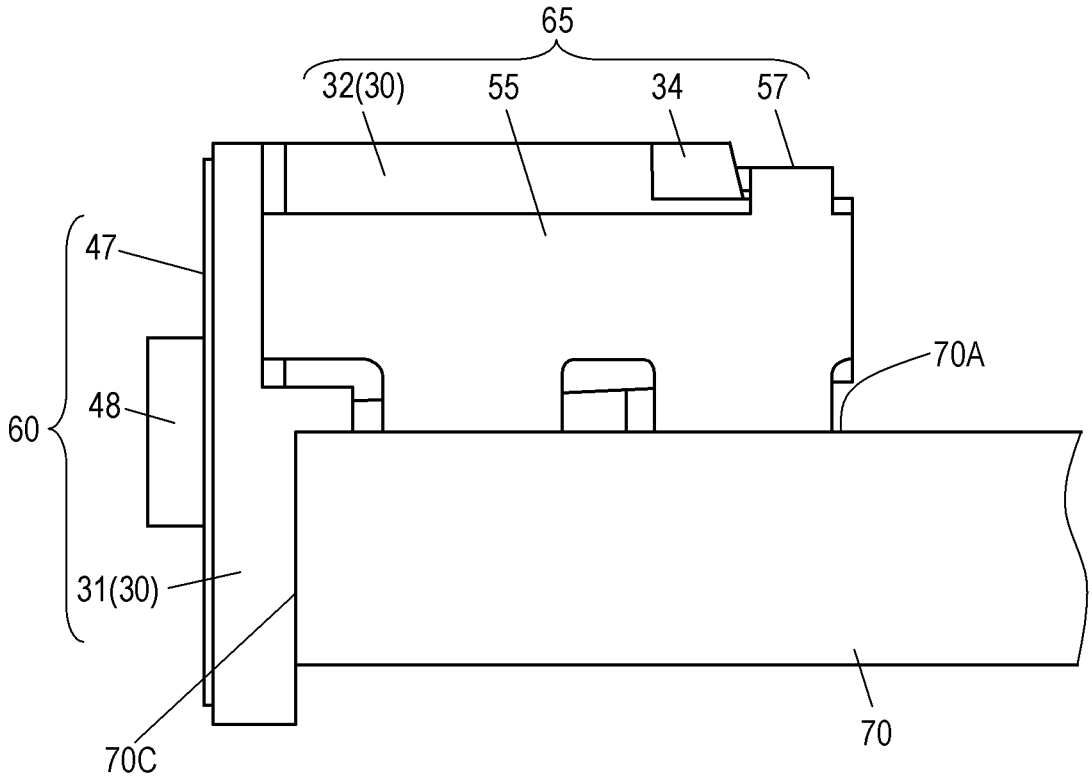
FIG. 7 is a side view of the push switch mounted onto the circuit board according to the embodiment.

FIG. 1 is a top view of push switch 1000 according to an exemplary embodiment of the present invention. FIG. 2 is a sectional view of push switch 1000 at line 2-2 shown in FIG. 1. FIGS. 3, 4 and 5 are an exploded perspective view, a bottom view, and a rear view of push switch 1000, respectively. FIG. 6 is a perspective view of push switch 1000 to be mounted onto circuit board 70. FIG. 7 is a side view of push switch 1000 mounted onto circuit board 70.

Case 30 made of resin includes front body portion 31 and rear body portion 32 connected to front body portion 31 at joint section 92, and has substantially an L-shape in the side view. Front body portion 31 forming one segment of the L-shape has a thin plate shape, and extends downward. Rear body portion 32 forming another segment of the L-shape has a thin plate shape which is perpendicular to front body portion 31 and extends horizontally back. They are formed into a single-piece structure such that an upper part of front body portion 31 and a front part of rear body portion 32 are connected at joint section 92. The edges at lower sides of both front body portion 31 and rear body portion 32 are not chamfered substantially, and are perpendicular the widthwise direction. Rear surface 31B of front body portion 31 is flat from the edge at the lower corner to the lower end of rear body portion 32.

Figure 8:
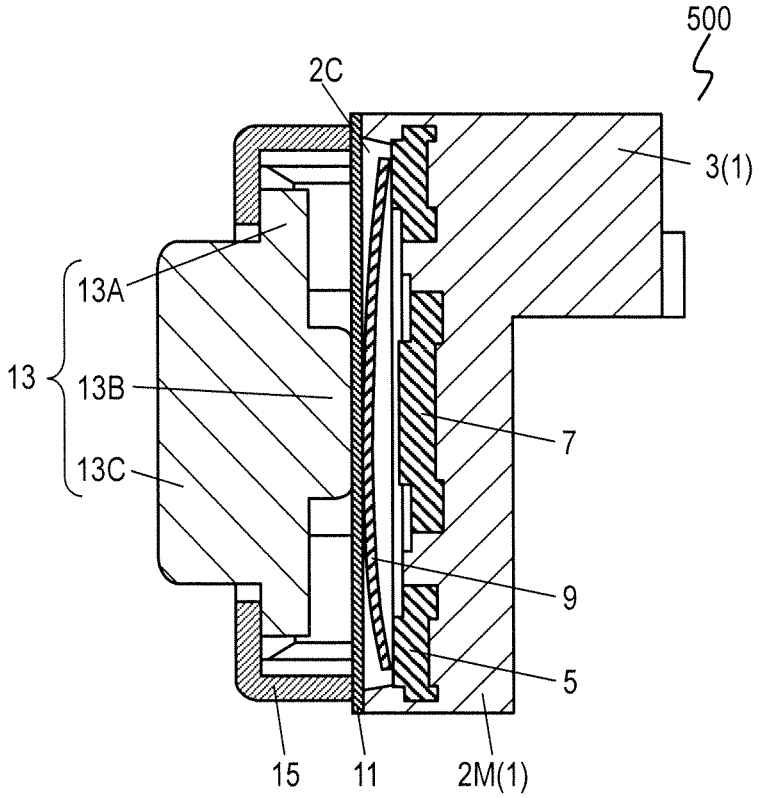
FIG. 8 (Prior Art)
FIG. 8 is a sectional view of a conventional push switch.

Front body portion 31 of case 30 has substantially a rectangular shape elongating laterally in the front view. Front body portion 31 has recess 31C therein. Recess 31C has substantially an oval shape or an elliptic shape that opens in the center of front surface 31A. Center contact 41 and outer contact 43 are fixed onto an inner bottom surface of recess 31C. The shape of recess 31C in front body portion 31 is different from the shape of recess 2C of conventional push switch 500 shown in FIG. 8. Front body portion 31 does not include bracket portions 3 of conventional push switch 500.

Movable contact 45 connects and disconnects electrically between center contact 41 and outer contact 43, and has a dome shape. Movable contact 45 has substantially an outer shape of an elliptic shape or an elongating shape that can be accommodated inside the recess 31C of case 30. Movable contact 45 is accommodated inside recess 31C of case 30 with the dome shape of movable contact 45 protruding forward. While movable contact 45 is accommodated inside recess 31C, an outer peripheral edge of the shorter side, the lowest edge position of the dome shape, of movable contact 45 contacts outer contact 43. Center contact 41, outer contact 43, and movable contact 45 constitute switch contact unit 91.

Recess 31C of case 30 is covered with insulation sheet 11 made of insulation film having flexibility. Pushing member 48 having a circular columnar shape made of resin is fixed to the front surface of insulation sheet 47 at a position corresponding to a vertex point of the dome shape of movable contact 45. Pushing member 48 may be placed between the back surface of insulation sheet 47 and the vertex of the dome shape of movable contact 45 instead of the front surface of insulation sheet 47. Insulation sheet 47 adheres to case 30 with, e.g. adhesive or welding. The portions discussed above as being related to front body portion 31 constitute front section 60 of push switch 1000.

Rear body portion 32 of case 30 has substantially a rectangular parallelepiped shape that extends from the upper rear part of front body portion 31 toward the rear side in a direction perpendicular to front body portion 31. Both the right and left sides of the rear part are tapered to become narrower in the upper view (cf. FIGS. 1 to 5).

Lead conductor 52 made of conductive material is disposed on the right side of rear body portion 32 in back view and extends from center contact 41 of switch contact unit 91. Lead conductor 52 extends horizontally toward the rear side with its thickness direction oriented in a side-to-side direction. Similarly, lead conductor 55 made of conductive material is disposed on the left side of rear body portion 32 from the back view and extends from outer contact 43. Lead conductor 55 also extends horizontally toward the rear side with its thickness direction oriented in the side-to-side direction.

According to the embodiment, lead conductors 52 and 55 extend individually such that their outer surfaces are parallel and to each other and flash with respect to the right and left end surfaces of front body portion 31. In other words, rear body portion 32 and lead conductors 52 and 55 fall within the width and height dimensions of front body portion 31 in direction D2 perpendicular to predetermined direction D1 in front view from predetermined direction D1. This structure is suitable to hold own the widthwise dimension of push switch 1000 as a whole, and to provide push switch 1000 with a small size.

It is readily feasible to make fine adjustment of the positions of lead conductors 52 and 55 since both the right and left sides of rear body portion 32 are tapered to become narrower toward the rear part, as discussed above, to provide so-called clearances. Rear body portion 32 may have a rectangular parallelepiped shape, and lead conductors 52 and 55 on the right and left sides of the rear body portion may extend along the rear body portion. Or, a part or all of lead conductors 52 and 55 may be embedded in rear body portion 32 as they extend along the rear body portion.

Lead conductor 52 on the right side of rear body portion 32 has parts bent from the side surface to bottom surface to wrap around rear body portion 32 and to face lower surface 32C of rear body portion at positions each corresponding to a middle position and a rear position of rear body portion 32, as shown in FIGS. 1 to 5. The parts that are bent to face lower surface 32C function as terminals 53 (53A and 53B). Similarly, lead conductor 55 on the left side of rear body portion 32 also has parts bent from the side surface to bottom surface to wrap around rear body portion 32 and to face lower surface 32C of rear body portion 32 at positions each corresponding to the middle position and the rear position of rear body portion 32, as shown in FIGS. 1 to 5. These parts that are bent to face lower surface 32C function as terminals 56 (56A and 56B).

Terminals 53A and 56A in the middle positions are located symmetrically and have shapes symmetrical to each other with respect to centerline 1000C extending between terminals 53A and 56A, and they fall within an outline of rear body portion 32 in the top view. Terminals 53B and 56B in the rear position extend longer and closer to centerline 1000C than terminals 53A and 56A of the middle position. Terminals 53B and 56B have areas large enough for soldering. Terminals 53 and 56 extend in a single flat plane from the bent corners at the side surfaces toward their tip ends (refer to FIG. 5).

Portions of lower surface 32C of rear body portion 32 facing terminals 53 and 56 are sloped such that terminals 53 and 56 are located away from terminals 53 and 56 as approaching centerline 1000C from the side surfaces of rear body portion 32, thereby providing clearances 32D between these portions and terminals 53 and 56, as shown in FIGS. 4 and 5. Clearances 32D allow fine adjustment of bent angles of terminals 53 and 56.

Center contact 41 has a contact surface configured to contact movable contact 45. Outer contact 43 has a contact surface contacting movable contact 45. Terminal 53 (55) has a connection surface to be connected with land 71. Center contact 41, outer contact 43, and terminal 53 (55) may be made of a bent single material, such as a plate. Terminals 53 and 56 may extend from lead conductors 52 and 55 with their one sides continuous with center contact 41 and outer contact 43 that contact movable contact 45 oriented to face the outside. That is, before the single material is bent, the contact surface of center contact 41, and the connection surface of terminal 53 (55) are provided on a single surface of the single material. In this case, the lower sides used as the soldering surfaces of terminals 53 and 56 become the same sides as that plated with silver or the like metals to serve as the contact surfaces. A single-sided plated material may be used as the plate.

The structure of the lead conductors, number and shape of the terminals and the like components can be altered or arranged otherwise as appropriate without being restricted by the structure described above.

Lead conductors 52 and 55 have upper clampers 54 and 57 in the rear position thereof, and they are latched to fastening projections 33 and 34 formed at the right and left side positions on an upper rear surface of rear body portion 32. This structure prevents lead conductors 52 and 55 from wobbling, but the structure to achieve this function is not limited to the above structure although it is preferable because of simplicity of the structure.

The portions discussed above as being related to rear body portion 32 constitute rear section 65 of push switch 1000. In addition, rear section 65 having the above structure falls within the widthwise dimension of front body portion 31 of front section 60 as described above. Moreover, the embodied component is constructed such that the front upper surface, that is, the upper surface of case 30 has a smooth flat plane, as shown in FIG. 1, and this portion is used as a surface to be sucked in the process of mounting.

As discussed above, push switch 1000 according to this embodiment has front section 60 and rear section 65 that compose substantially an L-shape in the side view in a single unit of complete component. In addition, this complete component of the above structure has the gravity center G1 set inside rear section 65.

Figure 9:
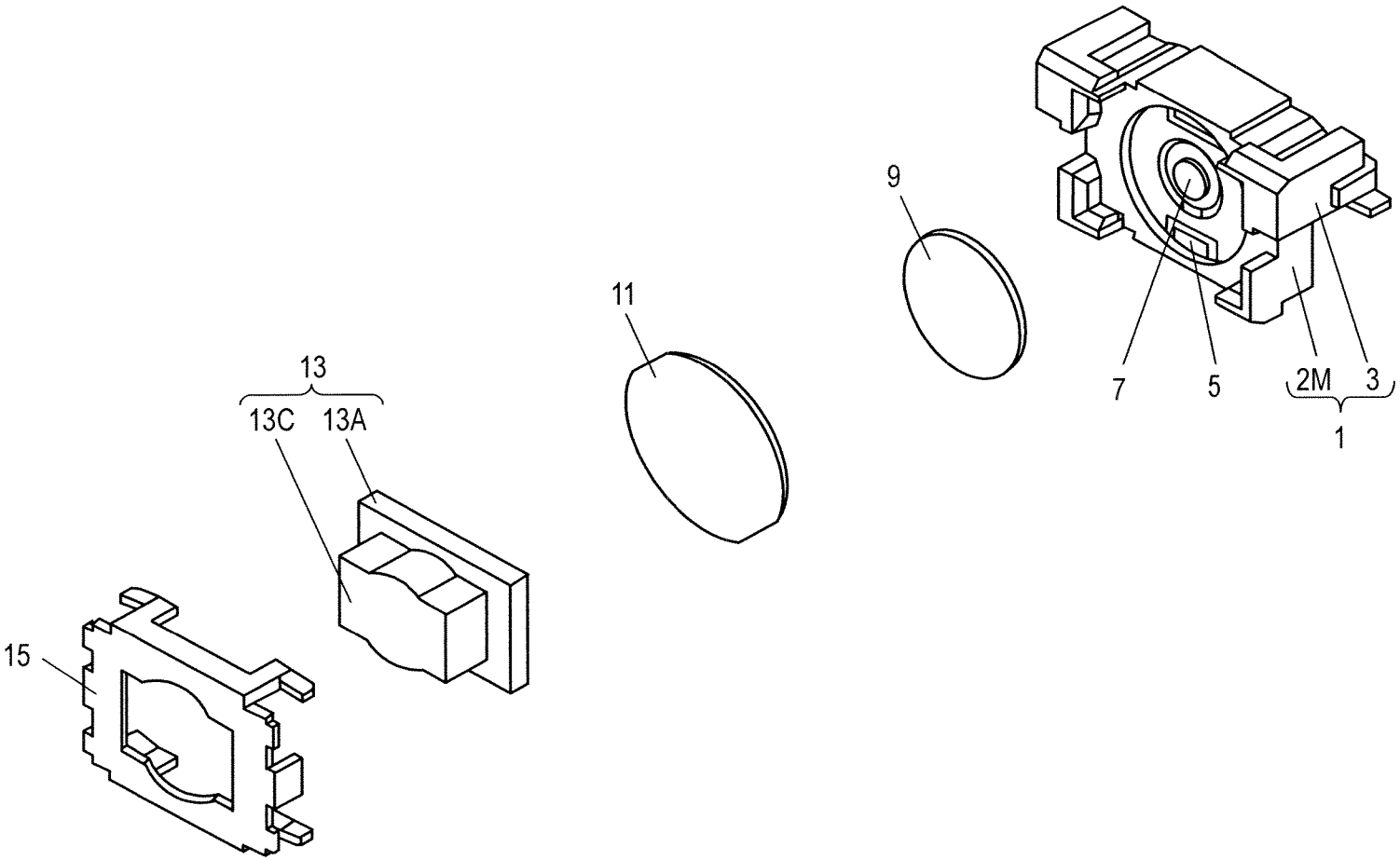
FIG. 9 (Prior Art)
FIG. 9 is an exploded perspective view of the conventional push switch.
Figure 10:
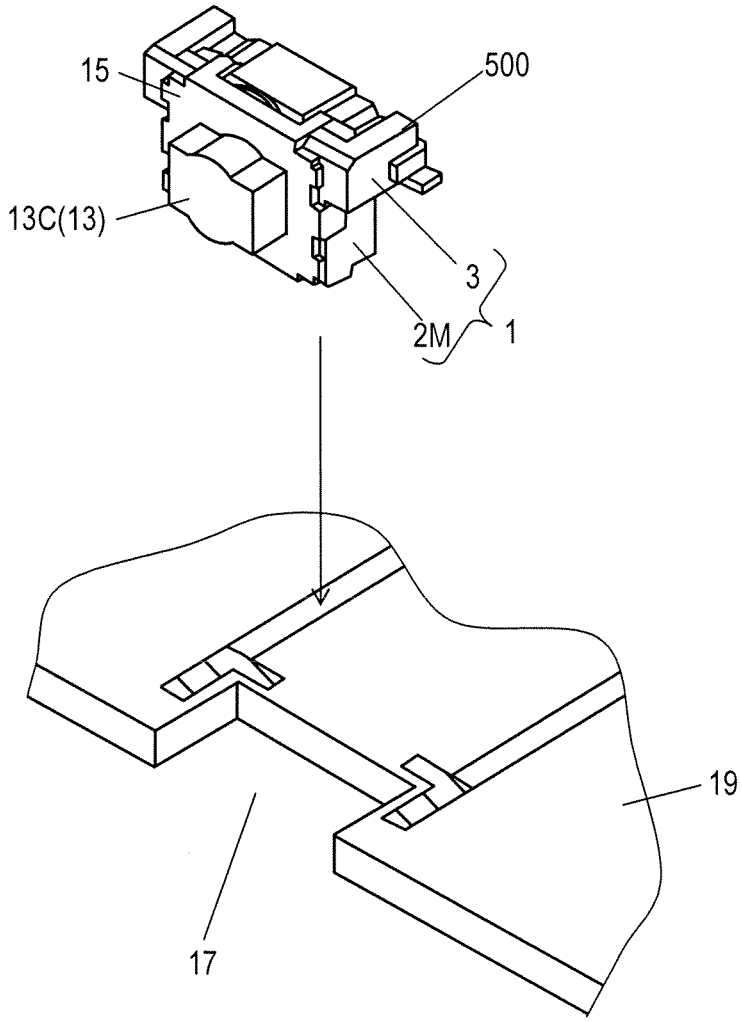
FIG. 10 (Prior Art)
FIG. 10 is a perspective view of the conventional push switch to be mounted onto a circuit board.
Figure 11:
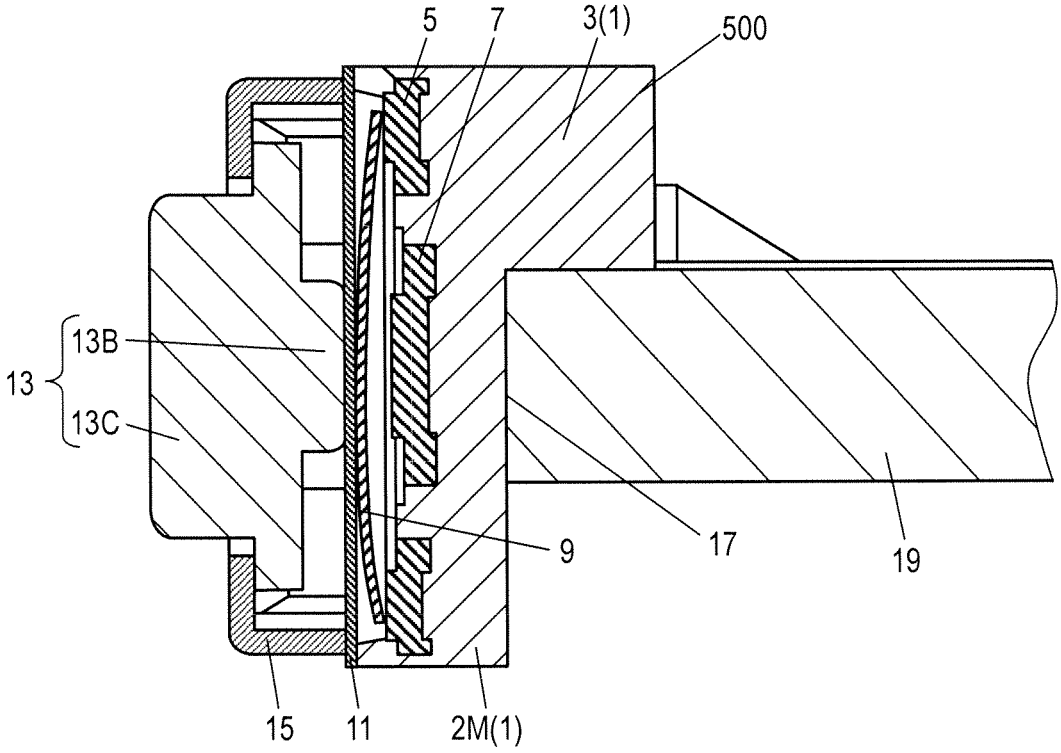
FIG. 11 (Prior Art)
FIG. 11 is a sectional view of the conventional push switch mounted onto the circuit board.

The position of gravity center G1 of push switch 1000 in the form of complete component is dependent upon designing of shapes and weights of two sides, front section 60 and rear section 65. An element of generally an elliptic shape having a narrow width is used as movable contact 45 of switch contact unit 91 accommodated within front body portion 31 in front section 60. Conventional push switch 500 shown in FIGS. 8 and 9 has bracket portions 3 to be supported from the underside. In push switch 1000 according to this embodiment, movable contact 45 is not provided with any of bracket portions 3, and it has a thin plate form of substantially a rectangular parallelepiped shape. This structure can reduce both the vertical dimension and weight of front section 60 on the foreside.

Since front section 60 has a small size and a light weight, it is possible to reduce the length of rear section 65 even though rear section 65 is designed to fall within the outline of front body portion 31 in the front view, hence providing push switch 1000 with small overall external dimensions with the gravity center positioned within rear section 65.

Push switch 1000 mounted will be described below with referring to FIGS. 6 and 7.

First, push switch 1000 and circuit board 70 for mounting are prepared. Circuit board 70 has a straight side edge in the top view, as shown in FIG. 6, that is, it the circuit board does not has a cutout, such as cutout 17 for the conventional switch. Lands 71 (71A and 71B) and 72 (72A and 72B) to be fixed to terminals 53 (53A and 53B) and 56 (56A and 56B) are provided on an upper surface 70A of the circuit board at positions near the side edge 70C of circuit board 70.

Lands 71 and 72 may preferably expend slightly larger to the outsides than the positions of individual lead conductors 52 and 55 of push switch 1000.

Lands 71 and 72 for fixing terminals 53B and 56B at rear positions of switch 1000 extend slightly wider toward the rear side with respect to a center position between terminals 53B and 56B. In other words, terminals 53B and 56B at the rear position of push switch 1000 have elongated shapes. This shape can greatly enhance the effect of self-alignment on the back of rear body portion 32 due to the tension of solder when melting cream solder changes into solid during the process of mounting with soldering. Lands 71B and 72B extend slightly wider toward the rear side with respect to the center position of terminals 53B and 56B to preferably enhance this effect significantly. Lands 71A and 72A corresponding to terminals 53A and 56A at the middle position may preferably have the same shapes.

The smooth flat area on an upper surface of case 30 from the joint section between front body portion 31 and rear body portion 32 toward rear body portion 32 is sucked with a suction head, and push switch 1000 is placed in a position on circuit board 70 so that terminals 53 and 56 sit on lands 71 and 72 coated with cream solder (cf. FIG. 6).

While push switch 1000 is placed on circuit board 70, as shown in FIG. 7, front section 60 is located at the outside of the side edge 70C of circuit board 70, and rear section 65 is located on circuit board 70 with the rear surface 31B of front body portion 31 contacting the front side edge 70C of circuit board 70 or being away with a small space from the front side edge 70C of circuit board 70.

Since push switch 1000 has the gravity center G1 lying in rear section 65 at the rear side, push switch 100 can be stably placed on circuit board 70 even when it is placed near the straight side edge 70C of circuit board 70 having no cutout, such as cutout 17 of the conventional structure, or even before being soldered. Push switch 1000 can also be held stably in the position of being placed even if it is placed on a circuit board having a cutout in front section 60 located in the cutout.

Subsequently, when the solder melts, the shape of lands 71B and 72B facing terminals 53B and 56B exhibit the effect of self-alignment as to shift push switch 1000 slightly rearward. This shifting causes the rear surface 31B of front body portion 31 to contact the front side edge 70C of circuit board 70, and push switch 1000 is mounted when terminals 53 and 56 are fixed with the solder while solder fillets are formed around outside areas of lead conductors 52 and 55 at bent corners of terminals 53 and 56.

Since terminals 53 and 56 are bent into such shapes that they fall within the outline of rear section 65, as described above, push switch 1000 can be mounted with soldering on a small area in the top view, thus being disposed into a small space by surface mounting. Terminals 53 and 56 may be sloped to increase height as being positioned toward the center of rear section 65, accordingly increasing areas for the solder to spread.

Since the gravity center G1 of push switch 1000 lies in rear section 65 at the rear side, the state of it being placed in position can be maintained stably even before being soldered or even while the solder melts, thereby achieving excellent mounting condition after the soldering.

An operation of push switch 1000 mounted on circuit board 70 of an apparatus will be described below.

Switch contact unit 91 is activated upon being pushed in predetermined direction D1. When front section 60 is pushed toward the rear side in the horizontal direction of circuit board 70, the pushing force is applied onto the center portion of movable contact 45 through pushing member 48. When the pushing force applied to movable contact 45 exceeds a predetermined amount, the center portion of the dome shape of movable contact 45 is reversed with a click feel, and the rear surface contacts center contact 41. This turns on switch contact unit 91 to electrically connect between center contact 41 and outer contact 43. The rear surface 31B of front section 60 may preferably contact the front side edge 70C of circuit board 70 after the solder mounting since it reduces an influence exerted on the areas fixed by soldering.

When the above pushing force is removed, movable contact 45 returns back to have the original forward convex shape and turns off switch contact unit 91 by electrically disconnecting between center contact 41 and outer contact 43.

Movable contact 45 of switch contact unit 91 flips to have the reversed shape as being pushed directly in the direction corresponding to the operational direction of movable contact 45 that is parallel to the surface of circuit board 70 on which switch 1000 is mounted. This operation provides an excellent feel of operation.

As described above, push switch 1000 can be held stably before being soldered even when it is placed near the side edge 70C of circuit board 70 having no cutout therein, and thus having a small shape that can be mounted by soldering. That is, circuit board 70 is not required to have a cutout therein, hence reducing the cost in addition to providing an extra space in an underside area at the side edge 70C of circuit board 70 where push switch 1000 is mounted that can be used for mounting certain electronic components or arranging other parts.

Push switch 1000 according to this embodiment is not limited only to the structure described above. For example, switch contact unit 91 may only need to electrically connect and disconnect between independent stationary contacts responsive to operation of the movable contact. Although the structure discussed above is designed to operate switch contact unit 91 through pushing member 48, the mechanism to operate switch contact unit 91 can be of a different form. Furthermore, the structure can be altered to eliminate the above mechanism, and front body portion 31 may have another configuration suitable for it when such is the case.

The structure of extending lead conductors 52 and 55 from center contact 41 and outer contact 43, or the positions of disposing the above-mentioned lead conductors 52 and 55 on rear section 65 may be different from the above structure. Moreover, the above structure illustrates both terminals 53 and 56 to have shapes bent to fall within the outline of rear section 65, but this is not restrictive either. In other words, the terminals can be of any other shapes such as a general surface mounting type of J-bent shape that protrudes outward, and a general dip-mounting type that protrudes downward. In addition, the terminals may be a combination of different shapes mentioned above, such that those terminals on the rear position have any of the shape bent to fall within the outline of rear section 65 and the general surface mounting type of J-bent shape that protrudes outward, and those terminals on the middle position have a shape that cannot be inserted in through-holes provided in the circuit board. Accordingly, rear body portion 32 may have a suitable configuration for such terminals.

Front body portion 31 and rear body portion 32 of case 30 may not be limited to the one formed of a resin into a single-piece structure. For instance, front body portion 31 and rear body portion 32 can be connected together after they are formed individually, and they may be formed with different materials from each other in this case.

Since the description provided above is just an exemplary structure including the minimum structural components, push switch 1000 may further include other components, such as a metal cover, that may have a configuration to be fixed to a corresponding land by soldering.

In addition, rear section 65 may further include an attachment part that adds a supplement weight to rear section 65, or any other means may be used to have the similar effect. An example of such means is a means having the function of engaging with circuit board 70 or the like component when it is placed or disposed onto circuit board 70, and staying in the disposed position even before the terminals are soldered.

As described above, push switch 1000 is configured to be mounted on upper surface 70A of circuit board 70. Circuit board 70 has land 71 provided on upper 70A and side edge 70C. Push switch 1000 includes front section 60 and rear section 65. Front section 60 includes switch contact unit 91 activated by being pushed in predetermined direction D1. Front section 60 is configured to be located outward from side edge 70C of circuit board 70. Rear section 65 includes terminal 53 connected with switch contact unit 91. Rear section 65 extends from front section 60. Rear section 65 is configured to be disposed on upper surface 70A of circuit board 70. Rear section 65 is connected with front section 60, and configures substantially an L-shape in combination with front section 60. Terminal 53 is configured to be connected with land 71 of circuit board 70. Predetermined direction D1 is parallel to upper surface 70A of circuit board 70. Gravity center G1 of push switch 1000 is located away from front section 60 in a direction in which rear section 65 extends from front section 60.

Front section 60 may extend downward from upper surface 70A of circuit board 70, and has substantially a rectangular shape elongating in parallel to upper surface 70A as viewed from predetermined direction D1. Rear section 65 may fall within a width of front section 60 in direction D2 parallel to upper surface 70A.

Rear section 65 may include rear body portion 32 (case 30) having lower surface 32C configured to face upper surface 70A of circuit board 70, and lead conductor 52 extending from switch contact unit 91 to terminal 53. In this case, terminal 53 is located on lower surface 32C of rear body portion 32 (case 30) and bent from lead conductor 52 toward terminal 53.

Front section 60 may extend downward from upper surface 70A of circuit board 70, and has substantially a rectangular shape elongating in parallel to upper surface 70A as viewed from predetermined direction D1. Rear section 65 may fall within a width of front section 60 in direction D2 parallel to upper surface 70A.

Switch contact unit 91 includes movable contact 45, center contact 41, and outer contact 43. Center contact 41 has a contact surface configured to contact movable contact 45. Outer contact 43 has a contact surface contacting movable contact 45. Terminal 53 (55) has a connection surface configured to be connected with land 71. Center contact 41, outer contact 43, and terminal 53 (55) may be made of a bent single material, such as a plate. In this case, before the single material is bent, the contact surface of center contact 41, the contact surface of outer contact 43, and the connection surface of terminal 53 (55) may be provided on a single surface of the single material.

In this embodiment, terms indicating directions, such as "upper surface", "lower surface", "downward", indicate relative directions that depend only on relative positions of structural components, such as case 30 and switch contact unit 91, of push switch 1000 and circuit board 70, and do not indicate absolute directions, such as a vertical direction.

What is claimed is:

1. A push switch configured to be mounted on an upper surface of a circuit board, the circuit board having a first land provided on the upper surface thereof and a side edge connected to the upper surface, the push switch comprising:

a front section including a switch contact unit activated by being pushed in a predetermined direction, the front section having a rear surface facing in the predetermined direction; and a rear section including a first terminal connected with the switch contact unit, the rear section extending from the front section in the predetermined direction, wherein the rear section is connected with the front section, and configures substantially an L-shape in combination with the front section, wherein the push switch is configured such that:

the front section is located outward from the side edge of the circuit board;

the rear surface of the front section faces the side edge of the circuit board;

the rear section is disposed on the upper surface of the circuit board; and the first terminal is connected with the first land of the circuit board, wherein the predetermined direction is parallel to the upper surface of the circuit board, and wherein a gravity center of the push switch is located away from the rear surface of the front section in the predetermined direction viewing from above the push switch.

2. The push switch of claim 1, wherein the front section extends downward from the upper surface of the circuit board, and has substantially a rectangular shape elongating in parallel to the upper surface as viewed from the predetermined direction, and wherein the rear section falls within a width of the front section in the direction parallel to the upper surface.

3. The push switch of claim 1, wherein the rear section includes:

a rear body portion having a lower surface configured to face the upper surface of the circuit board; and a lead conductor extending from the switch contact unit to the first terminal, and wherein the first terminal is located on the lower surface of the rear body portion and bent from the lead conductor toward the first terminal.

4. The push switch of claim 3, wherein the front section extends downward from the upper surface of the circuit board, and has substantially a rectangular shape elongating in parallel to the upper surface as viewed from the predetermined direction, and wherein the rear section falls within a width of the front section in the direction parallel to the upper surface.

5. The push switch of claim 1, wherein the circuit board further includes a second land provided on the upper surface thereof, wherein the rear section further includes a second terminal configured to be connected with the second land of the circuit board, and wherein an area of the second terminal is larger than an area of the first terminal.

6. The push switch of claim 1, wherein the circuit board further includes a second land provided on the upper surface thereof, wherein the rear section further includes a second terminal configured to be connected with the second land of the circuit board, and wherein a length of the second terminal in a direction perpendicular to the predetermined direction is larger than a length of the first terminal in the direction perpendicular to the predetermined direction.

7. The push switch of claim 1, wherein the rear surface of the front section is configured to contact the side edge of the circuit board.

8. The push switch of claim 1, wherein the rear surface of the front section is configured to face the side edge of the circuit board with a space between the rear surface of the front section and the side edge of the circuit board.

* * * * *